US009671156B2

(12) United States Patent
Hwang et al.

(10) Patent No.: US 9,671,156 B2
(45) Date of Patent: Jun. 6, 2017

(54) REFRIGERATOR

(71) Applicant: LG Electronics Inc., Seoul (KR)

(72) Inventors: Jungyeon Hwang, Seoul (KR); Jiyoung Park, Seoul (KR); Eunjoo Lee, Seoul (KR); Kyukwan Choi, Seoul (KR); Boram Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 615 days.

(21) Appl. No.: 14/190,303

(22) Filed: Feb. 26, 2014

(65) Prior Publication Data

US 2014/0239010 A1 Aug. 28, 2014

(30) Foreign Application Priority Data

Feb. 27, 2013 (KR) ..... 10-2013-0021360

(51) Int. Cl.
*F25D 25/00* (2006.01)
*F25D 23/12* (2006.01)

(52) U.S. Cl.
CPC ..... *F25D 23/126* (2013.01); *F25D 2400/361* (2013.01)

(58) Field of Classification Search
CPC ..... F25D 2400/361; F25D 23/126
See application file for complete search history.

(56) References Cited

U.S. PATENT DOCUMENTS 8,109,301 B1 * 2/2012 Denise ..... F25C 5/005 141/198
2008/0180020 A1 * 7/2008 Cok ..... H05B 33/28 313/503
2008/0295033 A1 * 11/2008 Lee ..... F25D 23/126 715/840
2010/0319389 A1 * 12/2010 Yang ..... F25D 23/126 62/389

* cited by examiner

*Primary Examiner* — Cassey D Bauer
(74) *Attorney, Agent, or Firm* — Dentons US LLP

(57) ABSTRACT

A refrigerator includes a main body having a storage chamber, a door opening or closing the storage chamber, and a dispenser provided at the door. The dispenser includes a dispenser housing that is recessed backward into the door to define a container accommodation space. A control panel unit includes a display part and a dispensing mode selection part. An image corresponding to the dispensing mode selected through the dispensing mode selection part is displayed on the display part as a moving picture by a control from a controller.

11 Claims, 8 Drawing Sheets

(a) (b) (c)

(a) (b) (c)

REFRIGERATOR

CROSS-REFERENCE TO RELATED APPLICATIONS

The present application claims the benefits of priority to Korean Patent Application No. 10-2013-0021360 filed on Feb. 27, 2013, which is herein incorporated by reference in its entirety.

BACKGROUND

The present disclosure relates to a refrigerator.

Refrigerators are home appliances for storing foods at a low temperature. Such a refrigerator includes one or all of a refrigerating compartment for storing foods in a refrigerated state and a freezing compartment for storing foods in a frozen state.

In recent years, a dispenser may be mounted on a front surface of a refrigerator door. Thus, ice within the refrigerator may be dispensed without opening the refrigerator door, and also, drinking water may be dispensed through the dispenser.

Korean Patent Registration No. 10-1203257 discloses a dispenser filed and registered by this applicant. In the dispenser, a display part is provided on a front surface of an ice chute through which ice is dispensed, and a still or moving picture corresponding to a menu is displayed through the display part.

SUMMARY

According to one embodiment, a refrigerator includes a dispenser in which a menu selected by a user is realized as a moving picture through an individual on/off control of light emitting diodes (LED) devices.

In one embodiment, a refrigerator includes: a main body having a storage chamber; a door opening or closing the storage chamber; and a dispenser provided at the door, wherein the dispenser includes: a dispenser housing that is recessed backward into the door to define a container accommodation space. A control panel unit includes a display part and a dispensing mode selection part, wherein an image corresponding to the dispensing mode selected through the dispensing mode selection part is displayed on the display part as a moving picture by a control of a controller.

The details of one or more embodiments are set forth in the accompanying drawings and the description below. Other features will be apparent from the description and drawings, and from the claims.

DETAILED DESCRIPTION OF THE EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Hereinafter, a refrigerator and a method thereof according to the embodiments will be described in detail with reference to the accompanying drawings.

Figure 1:
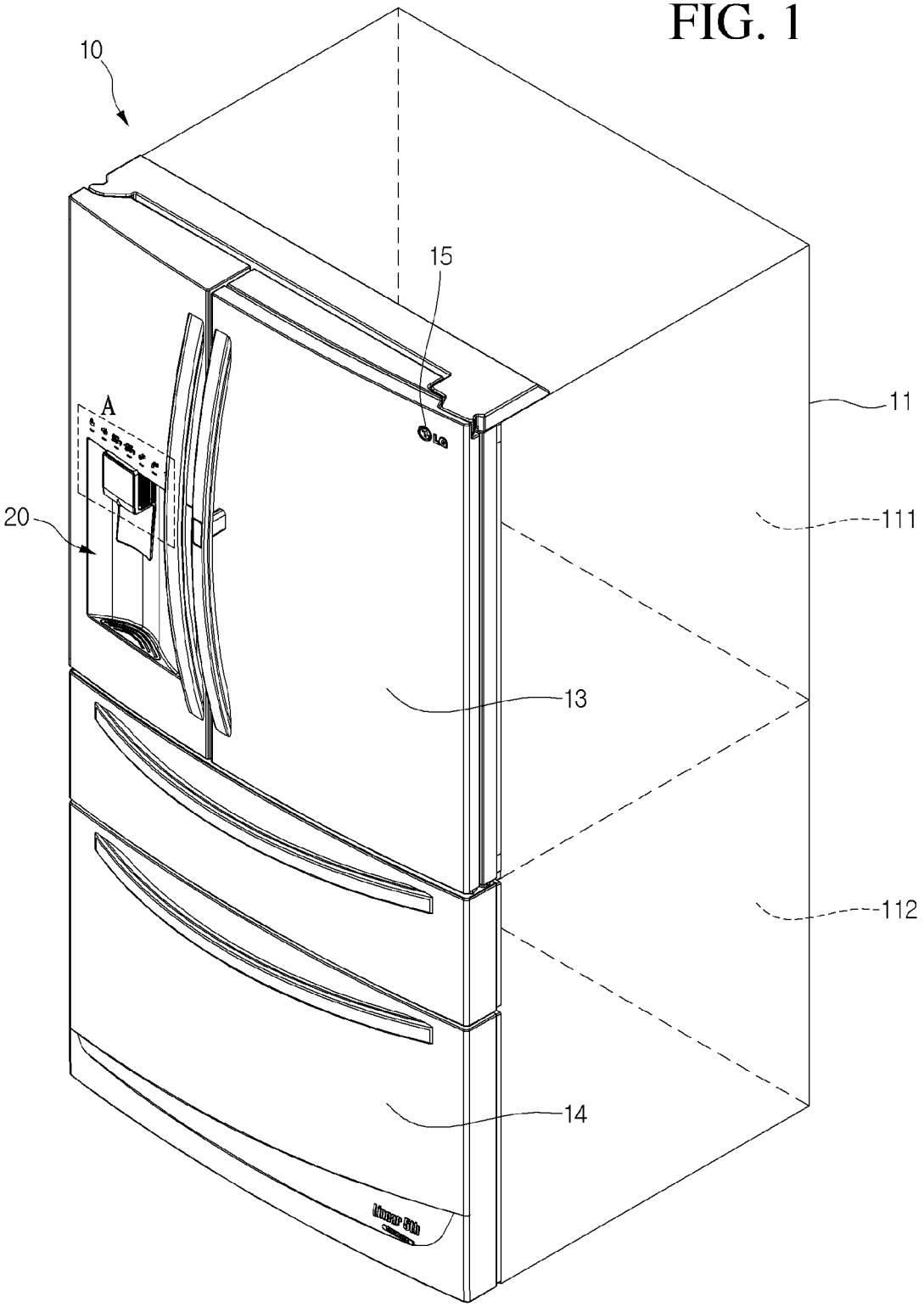
FIG. 1 is a perspective view of an outer appearance of a refrigerator according to an embodiment.

FIG. 1 is a perspective view of an outer appearance of a refrigerator according to an embodiment.

Referring to FIG. 1, a refrigerator 10 according to an embodiment includes a main body 11 having a refrigerating compartment 111 and a freezing compartment 112, a pair of refrigerating compartment door 13 rotatably coupled to a front surface of the main body 11 to selectively open or close the refrigerating compartment door 111, and a freezing compartment door 14 for selectively opening or closing the freezing compartment 112. The freezing compartment door 14 may be rotatably coupled, like the refrigerating compartment door 13. Alternatively, the freezing compartment door 14 may be provided as a drawer type in which a receiving box is coupled to a rear side thereof.

A dispenser 20 for dispensing water or ice may be provided in a front surface of the refrigerator door, for example, one of front surfaces of the pair of refrigerating compartment doors 13. Although the dispenser 20 is provided in the left refrigerating compartment door 13 in the current embodiment, the present disclosure is not limited thereto. For example, the dispenser 20 may be provided in the left refrigerating compartment door 13. Also, a control panel unit for displaying an operation state of the refrigerator and inputting an operation condition may be provided above the dispenser 20. Although a bottom freezer type refrigerator in which the freezing compartment 112 is defined under the refrigerating compartment 111 is exemplified in the current embodiment, the present disclosure is not limited thereto. For example, the current embodiment may be applied to a side-by-side type refrigerator. That is, the dispenser 20 and the control panel unit may be applied to a refrigerating compartment door of the bottom freezer type refrigerator as well as refrigerating and freezing compartment doors of the side-by-side type refrigerator.

Also, a logo display part 15 for displaying a brand name or manufacturer may be provided on an edge of an upper end of the front surface of the refrigerator 10. Particularly, the logo display part 15 may be provided on one or all of the refrigerating compartment door and the freezing compartment door. Also, the position of the logo display part 15 is not limited to the upper end of the front surface of the refrigerator 10. For example, the logo display part 15 may be provided on an area that is easily visible. In general, although the logo display part 15 is provided on the front surface of the door, and the present disclosure is not limited thereto.

Figure 2:
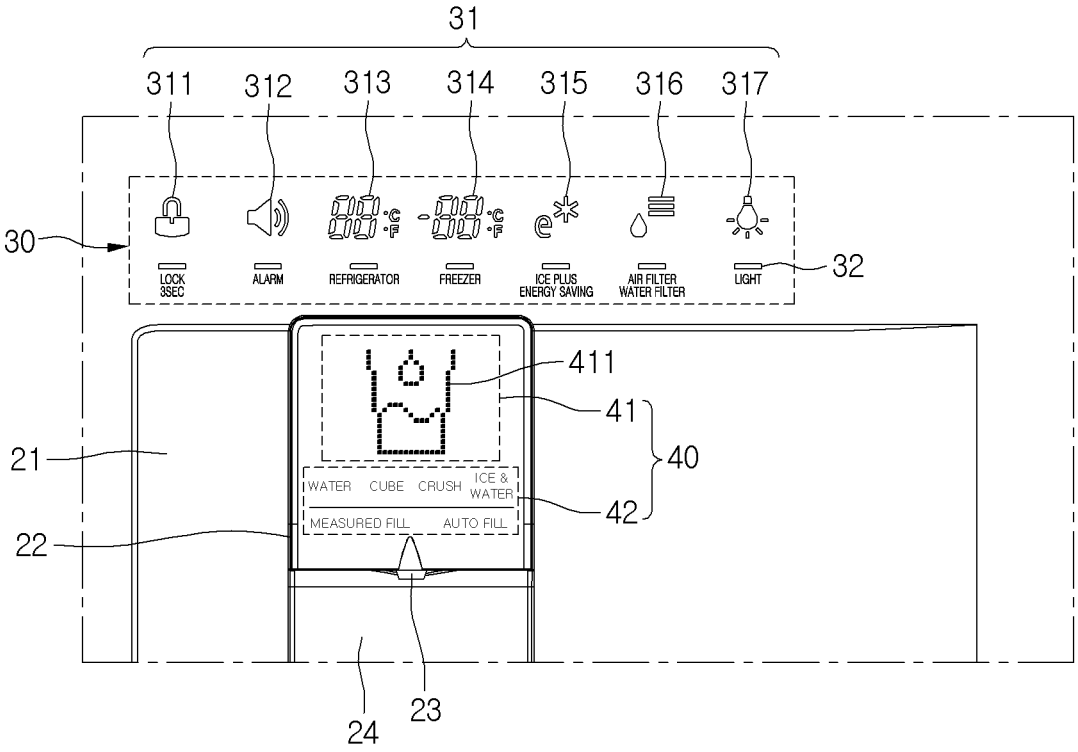
FIG. 2 is an enlarged view of a portion A of FIG. 1.
Figure 3:
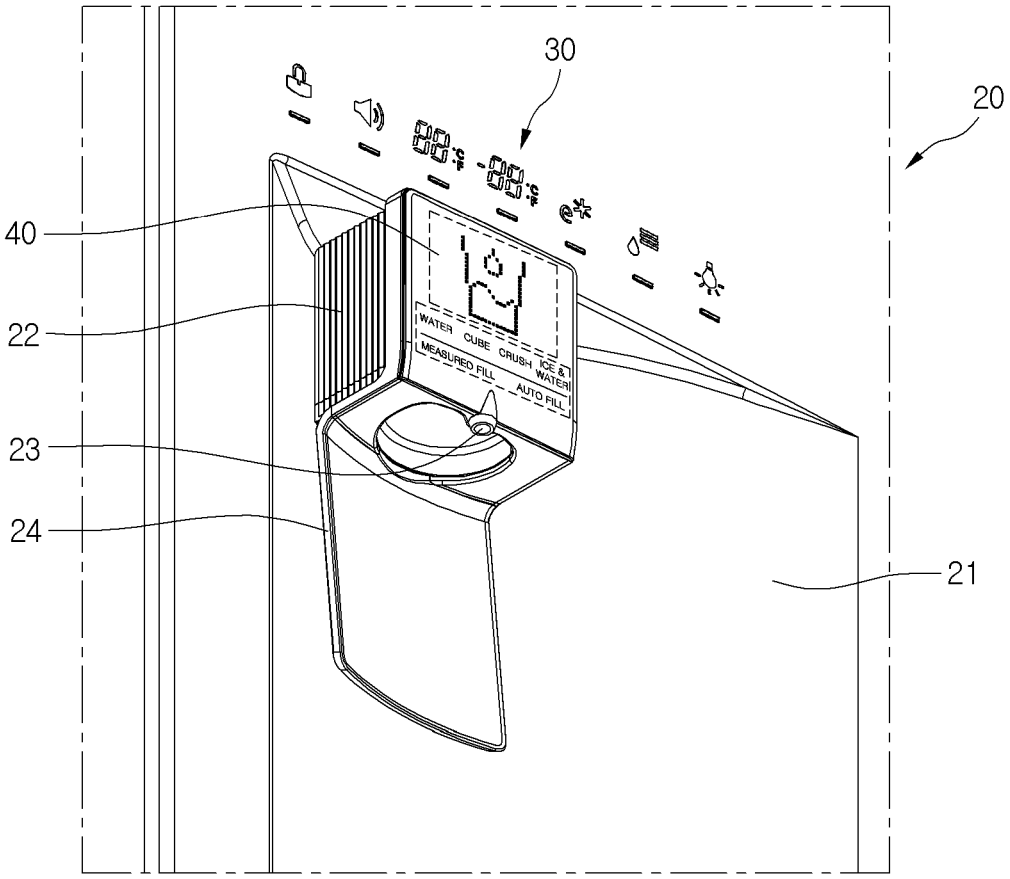
FIG. 3 is a bottom perspective view of a dispenser according to an embodiment.

FIG. 2 is an enlarged view of a portion A of FIG. 1, and FIG. 3 is a bottom perspective view of a dispenser according to an embodiment.

Referring to FIGS. 2 and 3, a main control panel unit 30 for displaying an operation state of the refrigerator and inputting an operation condition of the refrigerator may be provided on the front surface of the door 13 on which the dispenser 20 is mounted.

In detail, the main control panel unit 30 may be provided above the dispenser 20. Also, the dispenser 20 may include a dispenser housing 21 that is recessed backward by a predetermined depth to accommodate a container for receiving water or ice, an ice chute 22 protruding downward from an upper portion of the dispenser housing 21 to guide the dispensing of the ice, a water chute 23 disposed on a front lower end of the ice chute 22 to dispense water, and a push pad 24 disposed under the ice chute 22. The push pad 24 may be rotatably provided on a lower end of the dispenser housing 21 or the ice chute 22. That is, the push pad 24 may be independently rotatably coupled to the dispenser housing 21. Alternatively, as illustrated in the drawings, the push pad 24 may extend from a rear lower end of the ice chute 22 and be integrated with the ice chute 22. Also, the push pad 24 may be configured to input a command for dispensing water or ice when the push pad 24 is pushed and then released.

Also, a sub control panel unit 40 may be provided on a front surface of the ice chute 22. In detail, the sub control panel unit 40 may include a mode selection part 42 for selecting a dispensing mode and a display part 41 on which a mode identification image 411 for showing the dispensing mode selected at the mode selection part 42 is displayed.

The mode selection part 42 may include a selection part (that is displayed as the term "water") for selecting water, a selection part (that is displayed as the term "cube") for selecting cubed ice, a selection part (that is displayed as the term "crush") for selecting crushed ice, a selection part (that is displayed as the term "ice & water") for selecting simultaneous dispensing of water and ice, a selection part (that is displayed as the term "measured fill") for selecting dispensing of a preset amount of water, and a selection part (that is displayed as the term "auto fill") for selecting a function for automatically filling the container with water.

For example, when a detection unit such as a distance sensor is mounted on a bottom of the dispenser housing 21, water or ice may be automatically dispensed, regardless of a size of the container. Then, the container is filled up to a set level with the water or ice, and the dispensing of the water or ice may be stopped automatically. The mode selection part 42 may include a touch-sensor type input button. Also, a position sensitive detector (PSD) sensor, a charge-coupled device (CCD) image sensor, a complementary metal-oxide semiconductor (CMOS) image sensor, or an infra-red (IR) sensor may be used as the distance sensor.

Also, the selected dispensing mode may be displayed on the display part 41 as a moving picture to inform the selected dispensing mode to the user. In detail, the display part 41 may be a display on which a plurality of light emitting diodes (LED) devices are arranged, and each of LED devices is turned on/off to realize to corresponding moving pictures. This will be described below in detail with reference to the accompanying drawings. Alternatively, the display part 41 may be a liquid crystal display (LCD) device. However, for purposes of this disclosure, the LED devices cover all display devices.

The main control panel unit 30 may include a state information display part 31 for displaying an operation condition or state of the refrigerator and an operation condition input part 32 for inputting the operation or state condition of the refrigerator.

In detail, the state information display part 31 may display the operation condition or state of the refrigerator as a figure or character using a design or 88 segments, and the operation condition input part 32 may include a touch-sensor type input button to display the operation or state condition of the refrigerator on a lower portion of a touch sensor as a character. Thus, the user touches a portion of the touch sensor to set an operation condition, e.g., an operation condition such as a temperature of the refrigerating compartment or freezing compartment.

The state information display part 31 may include a locking/unlocking set-up part 311 for allowing or blocking an operation condition input, an alarm set-up part 312 for informing a warning sound when an opened state of the refrigerator is maintained for a preset time or more, a refrigerating compartment temperature set-up part 313, a freezing compartment temperature set-up part 314, an ice making/energy saving set-up part 315 for blocking other functions for a period of time to save energy consumption, thereby performing quick ice making process, a filter replacement informing set-up part 316 for setting or releasing filter replacement period information, and a lighting set-up part 317 for setting the turn-on of lightings of a discharge port and the push pad of the ice chute. When the lighting set-up part 317 is touched to turn the lighting on, a light emitting part may be turned on even though the push pad is not pushed. Thus, the user may easily find the water or ice dispensing port at night. On the other hand, when the lighting set-up part 317 is set to lighting-off, the lighting may be turned on only when the push pad is pushed to achieve the power saving effect.

Figure 4:
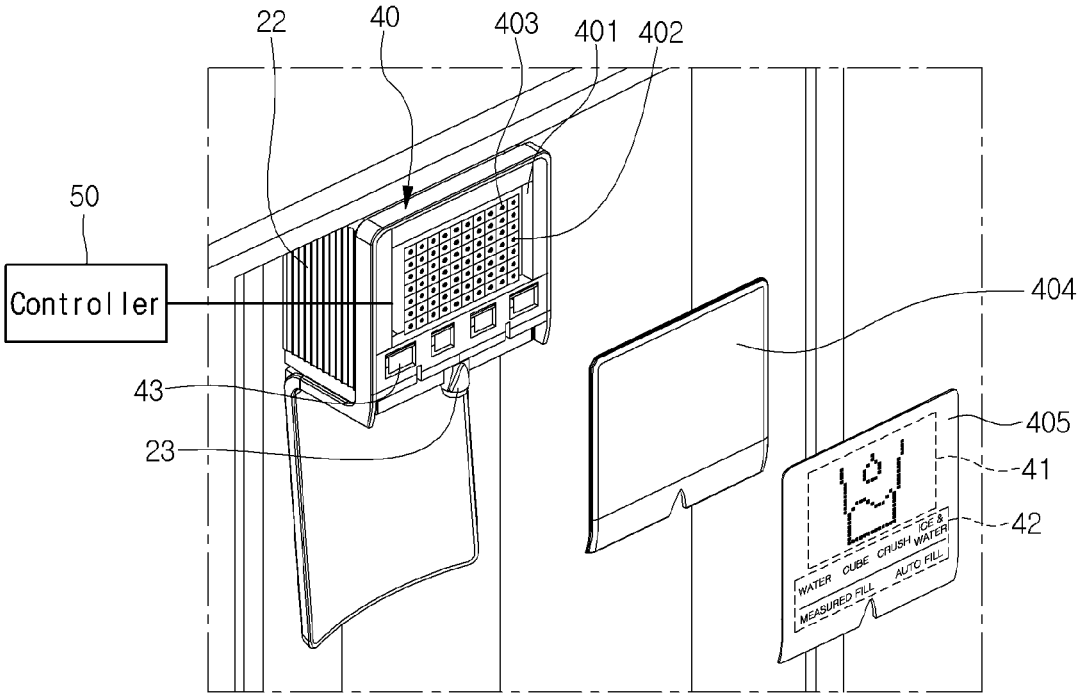
FIG. 4 is an exploded perspective view of a sub control panel unit according to an embodiment.

FIG. 4 is an exploded perspective view of a sub control panel unit according to an embodiment.

Referring to FIG. 4, the sub control panel unit 40 according to an embodiment is provided on the front surface of the ice chute 22.

In detail, the sub control panel unit 40 includes a panel housing 401 in which an LED panel 402 is accommodated, a cover panel 404 formed of a transparent material and attached to a front surface of the LED panel 402, and a black sheet 405 adhering to a front surface of the cover panel 404. Also, a plurality of touch sensors 43 are mounted under a groove in which the LED panel 402 is mounted. The plurality of touch sensors 43 may be provided in a region of the mode selection part 42. Thus, when the user touches the touch sensors 43 by using their fingers thereof, the dispensing mode may be selected.

Also, a plurality of LED devices 403 may be arranged on the LED panel 402 in a matrix form. The plurality of LED devices 403 may be individually turned on/off by a controller 50 to realize an image corresponding to the selected dispensing mode as a moving picture. That is to say, an image having a specific shape may be realized by the LED devices that are turned on. Also, as time elapses, the LED devices are turned on or off, and the image may be realized as a moving picture.

The cover panel 404 may be manufactured by using a transparent glass or plastic injection molded material. The cover panel 404 may cover the LED panel 402 and the touch sensor 43.

Also, the black sheet 405 is attached to a front surface of the cover panel 404. In detail, the black sheet 405 may be formed of a material that reflects light irradiated from the outside to prevent the user from viewing the inside of the of the sub control panel unit 40. On the other hand, light irradiated from the LED panel 402 may transmit through the black sheet 405 to allow the user to view the visual of the sub control panel part 40. Thus, in a state where all of the LED devices 403 constituting the LED panel 402 are turned off, the front surface of the sub control panel unit 40 may be shown as a black color. When the LED devices 403 are turned on, light emitted from the corresponding devices may be visible to the user.

A representation, for example, a character for displaying the dispensing mode may be printed on a front surface of the black sheet 405. Also, the character for displaying the dispensing mode may be printed on an area on which the touch sensor 43 is mounted. When the user touches the dispensing mode display character, the corresponding touch sensor 43 may detect the touch of the dispensing mode display character.

FIGS. 5 to 11 are views of a moving picture that is realized on the display part of the sub control panel unit 40 according to an embodiment.

Figure 5:
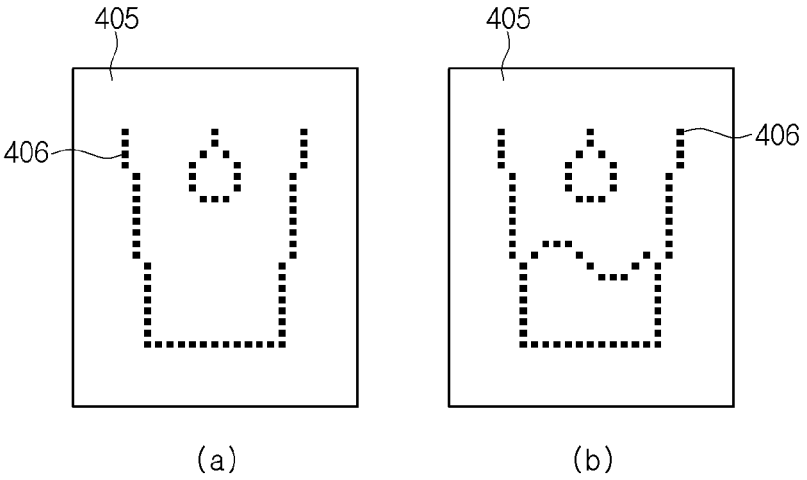
FIGS. 5(*a*)-5(*b*) are views of a moving picture that is realized on a display part of the sub control panel unit when a water dispensing mode is selected according to an embodiment.

Referring to FIGS. 5(*a*)-5(*b*), when the user touches the water dispensing mode that is expressed as the term "WATER", a moving picture in which water is filled into a water cup may be displayed on the display part 41 as illustrated in FIGS. 5(*a*)-5(*b*).

In detail, as illustrated in FIG. 5(*a*), an image that a water drop drops into an empty water cup may be displayed first. The image may be realized when only the LED device, which is disposed on an area on which the image is formed, of the plurality of LED devices 403 provided on the LED panel 402 is turned on. Also, when a predetermined time elapses, the LED device that is turned on may be changed. As illustrated in FIG. 5(*b*), an image in which water is partially filled in the water cup may be realized. Also, the image illustrated in FIG. 5(*a*) and the image illustrated in FIG. 5(*b*) may be alternately displayed. Thus, the user may see that the water dispensing mode is selected. While the water is dispensed, the two images are alternately displayed and thus recognized as if a moving picture is realized. In other method, the LED devices 403 may be turned on or off so that a moving picture in which a water drop image in FIG. 5(*a*) is rolled down to the state of the image illustrated in FIG. 5(*b*).

Figure 6:
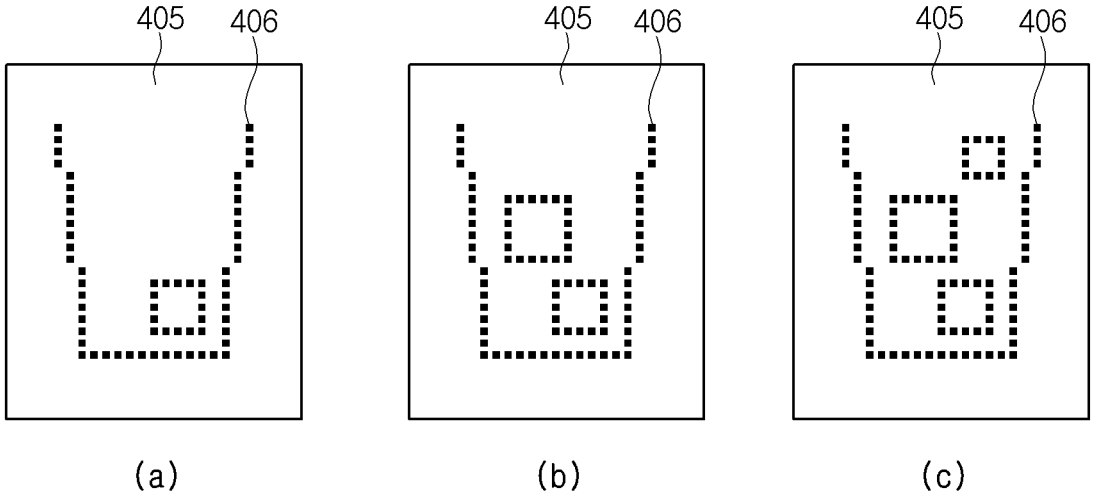
FIGS. 6(*a*)-6(*c*) are views of a moving picture that is realized on a display part of the sub control panel unit when a cubed ice dispensing mode is selected according to an embodiment.

Referring to FIGS. 6(*a*)-6(*c*), when the user touches the cubed ice dispensing mode that is expressed as the term "CUBE", images illustrated in FIGS. 6(*a*) to 6(*c*) may be successively realized and repeatedly displayed until the dispensing of the cubed ice is stopped. As a result, the images may be displayed as a moving picture in which the cubed ice is filled in the cup.

Figure 7:
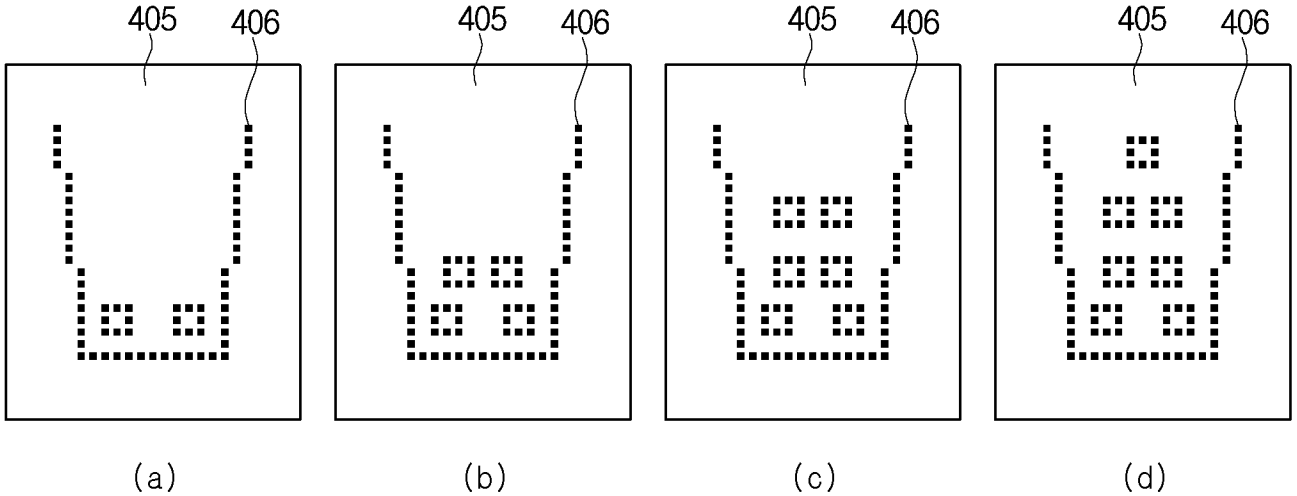
FIGS. 7(*a*)-7(*d*) are views of a moving picture that is realized on a display part of the sub control panel unit when a crushed ice dispensing mode is selected according to an embodiment.

Referring to FIGS. 7(*a*)-7(*d*), when the user touches the crushed ice dispensing mode that is expressed as the term "CRUSH", images illustrated in FIGS. 7(*a*) to 7(*d*) may be successively displayed on the display part 41 and repeatedly displayed until the dispensing of the crushed ice is stopped.

Figure 8:
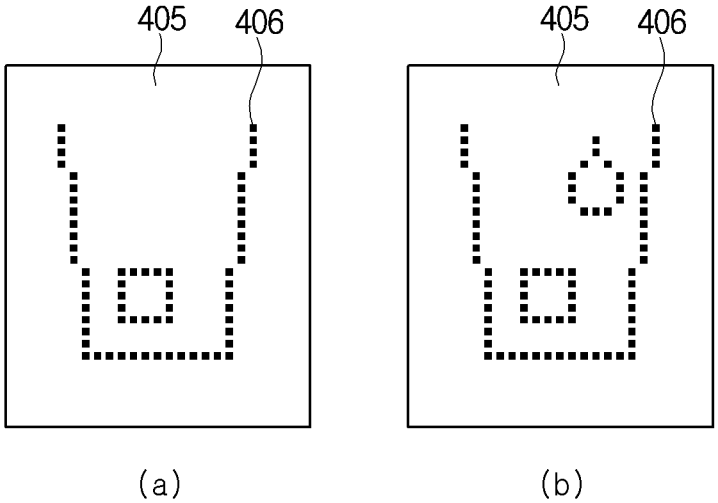
FIGS. 8(*a*)-8(*b*) are views of a moving picture that is realized on a display part of the sub control panel unit when a water and ice dispensing mode is selected according to an embodiment.

Referring to FIGS. 8(*a*)-8(*b*), when the user touches the water/ice dispensing mode that is expressed as the term "ICE & WATER", water and ice may be dispensed at the same time, and also, images illustrated in FIGS. 8(*a*) and 8(*b*) may be successively and repeatedly displayed until the dispensing of the water and ice is stopped. Alternatively, the LED devices 403 may be turned on or off so that a moving picture in which ice drop in FIG. 8(*a*) is rolled down to the state of the image illustrated in FIG. 8(*b*).

Figure 9:
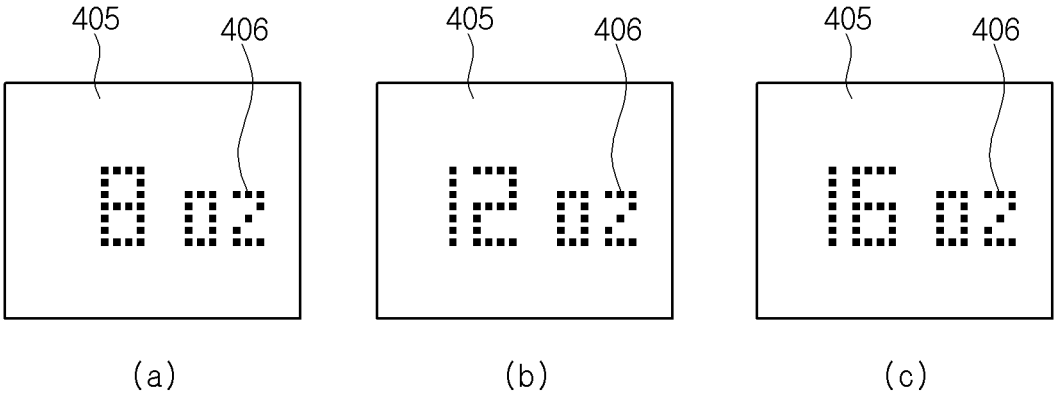
FIGS. 9(*a*)-9(*c*) are views that are realized on a display part of the sub control panel unit when a flow rate dispensing mode is selected according to an embodiment.

Referring to FIGS. 9(*a*)-9(*c*), when the user touches the set flow rate dispensing mode that is expressed as the term "MEASURED FILL", a figure corresponding to a flow rate may be changed as often as the set-up flow rate dispensing mode display part is touched. That is, when the set flow rate dispensing mode display part is touched once, an amount of dispensed water may be set to and displayed as about 8 ounces. When the set flow rate dispensing mode display part is touched twice, an amount of dispensed water may be set to and displayed as about 12 ounces. Also, when the set flow rate dispensing mode display part is touched three times, an amount of dispensed water may be set to and displayed as about 16 ounces. In the set-up flow rate dispensing mode, a figure corresponding to the set flow rate may be fixedly displayed until the set flow rate is completely dispensed.

Figure 10:
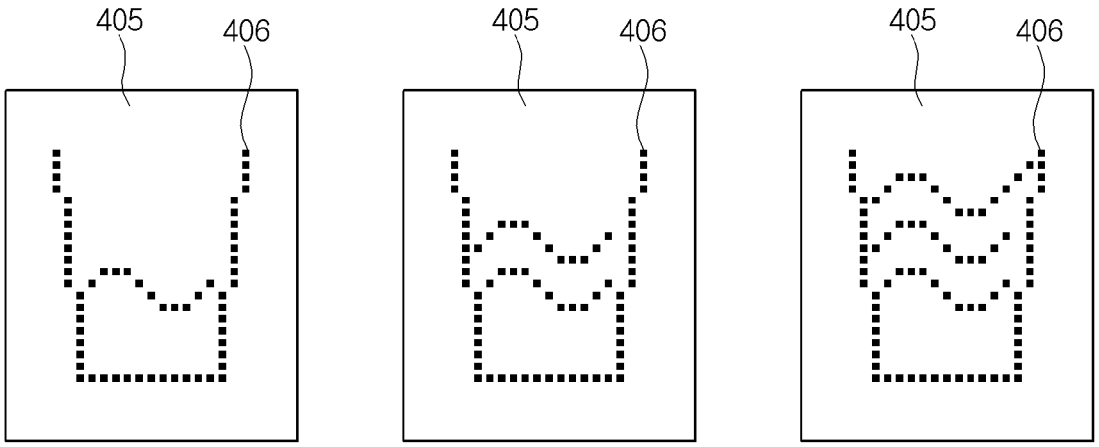
FIGS. 10(*a*)-10(*c*) are views of a moving picture that is realized on a display part of the sub control panel unit when an automatic water supply dispensing mode is selected according to an embodiment.

Referring to FIGS. 10(*a*)-10(*c*), when the user touches the automatic water supply mode that is expressed as the term "AUTO FILL", images illustrated in FIGS. 10(*a*) to 10(*c*) may be successively and repeatedly displayed on the display part 41. That is, the number of lines having a wave shape may increase as time elapses. Thus, it appears that the water level is increasing. Also, when a water supply ending time is detected by the sensor for detecting the water level, the repeated display of the images may be stopped.

Figure 11:
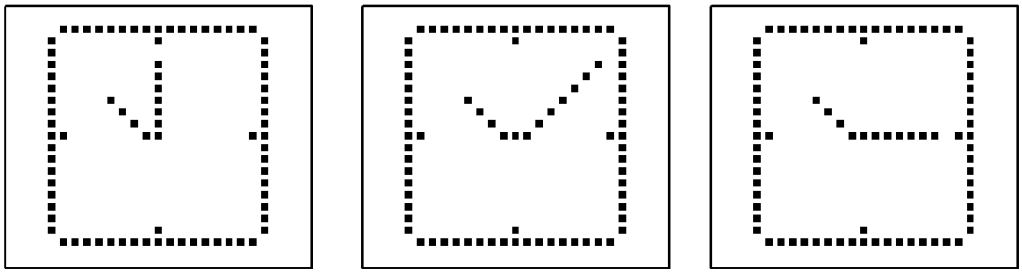
FIGS. 11(*a*)-11(*c*) are views of a moving picture that is realized on a display part of the sub control panel unit when no dispensing mode is selected according to an embodiment.

FIGS. 11(*a*)-11(*c*) are views of a state in which a watch is displayed on the display part 41 in a state where the user does not select the dispensing mode.

In the state where the dispensing mode is not selected, no image may be displayed. Thus, the front surface of the sub control panel unit 40 may be displayed as the black color. However, as illustrated in FIGS. 11(*a*)-11(*c*), a moving picture image of a watch for informing the present time may be displayed to perform an additional function. That is, as time elapses, an hour hand and a minute hand may move to allow the user to see the present time through the display part 41, thereby providing an additional service.

Alternatively, in the state where the dispensing mode is not selected, an image of the last selected dispensing mode may be displayed as a still picture. When the user pushes the push pad 24 without selecting the dispensing mode at the present state, the user may view what dispensing mode was previously performed.

For example, if it is assumed that the last performed dispensing mode is the water dispensing mode, in a case where it is intended to dispense water, the user may determine that it is unnecessary to select the dispensing mode again. In a case where it is intended to dispense ice, the user may recognize that the push pad 24 has to be pushed after the ice dispensing mode is selected. As a result, it may prevent the dispensing material that is not intended by the user from being filled into the container.

According to the refrigerator including the above-described embodiments, the plurality of LEDs may be arranged on the back surface of the display part. The LEDs may be individually turned on or off to realize the image corresponding to the menu, which is selected by the user, on the display part as the moving picture.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:
a main body having a storage chamber;
a door opening or closing the storage chamber; and
a dispenser provided at the door,
wherein the dispenser comprises:
a dispenser housing that is recessed backward into the door to define a container accommodation space;
a control panel unit comprising a display part and a dispensing mode selection part;
a controller; and
a plurality of LED devices,
wherein the controller turns on and off the plurality of LED devices to realize the image as the moving picture at the display part,
wherein an image corresponding to a dispensing mode selected through the dispensing mode selection part is displayed at the display part as a moving picture by a control from the controller,
wherein the control panel unit comprises:
an LED panel on which the LED devices are arranged,
a plurality of touch sensors disposed under the LED panel,
a transparent cover panel disposed on a front surface of the LED panel, and
a sheet attached to a front surface of the transparent cover panel, and
wherein the sheet reflects light irradiated from the outside and transmits light irradiated from the LED panel through the sheet.

2. The refrigerator according to claim 1, further comprising:
an ice chute extending downward from a top surface of the dispenser housing; and
a push pad disposed under the ice chute,
wherein the control panel unit is provided on a front surface of the ice chute.

3. The refrigerator according to claim 1, wherein the sheet is a black sheet and causes a front surface of the control panel unit to be black when the all the LED devices are turned off.

4. A refrigerator comprising:
a main body having a storage chamber;
a door opening or closing the storage chamber; and
a dispenser provided at the door,
wherein the dispenser comprises:
a dispenser housing that is recessed backward into the door to define a container accommodation space;
a control panel unit comprising a display part and a dispensing mode selection part;
a controller; and
a plurality of LED devices,
wherein the controller turns on and off the plurality of LED devices to realize the image as the moving picture at the display part,
wherein an image corresponding to a dispensing mode selected through the dispensing mode selection part is displayed at the display part as a moving picture by a control from the controller,
wherein the control panel unit comprises:
an LED panel on which the LED devices are arranged,
a plurality of touch sensors disposed under the LED panel,
a transparent cover panel disposed on a front surface of the LED panel, and
a sheet attached to a front surface of the transparent cover panel,
wherein a representation representing the dispensing mode in the dispensing mode selection part is printed on a surface of the sheet.

5. The refrigerator according to claim 4, wherein the representation is printed on the surface of the sheet corresponding to a position on which the touch sensor is mounted.

6. The refrigerator according to claim 1, wherein the moving picture is repeatedly displayed until the selected dispensing mode is stopped.

7. The refrigerator according to claim 2, wherein the moving picture is repeatedly displayed while the push pad is engaged.

8. The refrigerator according to claim 1, wherein when the dispensing mode selected is an amount of dispensed water, the image displayed on the displayed unit is the amount of dispensed water selected as a still picture.

9. The refrigerator according to claim 1, wherein, in a state where a dispensing operation is not performed, an image corresponding to a last performed dispensing mode is displayed on the display part as a still picture.

10. The refrigerator according to claim 2, wherein when the push pad is engaged without the dispensing mode selected through the dispensing mode selection part, the dispensing mode corresponding to the last performed dispensing mode is selected by the controller.

11. The refrigerator according to claim 1, further comprising displaying a clock at the display part when no dispensing mode is selected through the dispensing mode selection part.

* * * * *